US006508572B2

(12) United States Patent
Kumada

(10) Patent No.: US 6,508,572 B2
(45) Date of Patent: Jan. 21, 2003

(54) GARLAND LIGHT SET

(75) Inventor: Isao Kumada, Atsugi (JP)

(73) Assignee: Sienna, LLC, Oakland, NJ (US)

( * ) Notice: Subject to any disclaimer, the term of this patent is extended or adjusted under 35 U.S.C. 154(b) by 0 days.

(21) Appl. No.: 09/770,836

(22) Filed: Jan. 26, 2001

(65) Prior Publication Data

US 2002/0101735 A1 Aug. 1, 2002

(51) Int. Cl.[7] ..... F21S 13/14

(52) U.S. Cl. ..... 362/252; 362/249; 362/391; 362/806

(58) Field of Search ..... 362/252, 249, 362/806, 391

(56) References Cited

U.S. PATENT DOCUMENTS 5,915,827 A * 1/1999 Wang ..... 362/252
5,868,490 A * 2/1999 Barthelmess ..... 362/252
6,135,616 A * 10/2000 Rahman ..... 362/249
5,302,562 A1 * 10/2001 Wu ..... 362/252

* cited by examiner

*Primary Examiner*—Sandra O'Shea
*Assistant Examiner*—Mark Tsidulko
(74) *Attorney, Agent, or Firm*—Amster, Rothstein & Ebenstein

(57) ABSTRACT

A garland light set is formed by a plurality of longitudinally-extending light strings physically twisted together to define a garland extending along a longitudinal axis. Each of the light strings includes a plurality of lamp sockets electrically wired in series and longitudinally spaced along a longitudinal axis of the respective light string, wires physically and electrically connecting in series each lamp socket of a respective light string along the respective longitudinal light string axis, and clips for orienting each lamp socket generally coaxially with the respective longitudinal light string axis.

35 Claims, 6 Drawing Sheets

GARLAND LIGHT SET

BACKGROUND OF THE INVENTION

The present invention relates to a garland light set and, more particularly, to a garland light set which emulates the appearance of a floral garland.

A floral garland was originally a bunch of flowers having the long thin stem portions thereof twisted together to form a relatively thick rope-like wreath structure (e.g., a braid or plait) and the even thicker ornamental bloom or head portions of the flowers disposed at generally regularly spaced intervals along the longitudinal or stem length of the structure. In more commercial terms, a garland is a linear, arcuate or circular frame having flowers or flower simulations secured to the frame at regularly spaced intervals along its longitudinal axis. Translating this design into modern light set terminology, a garland is a linear, arcuate or circular configuration of twisted electrical wires having light sockets (and lamps) or groups of such light sockets (and lamps) disposed at regularly spaced intervals along the length of the twisted wires.

While a garland light set may be relatively short if it is only to encircle a Christmas tree, for more general applications such as encircling a chimney, a door frame, a portion of a house roof, or the like, a garland is preferably of substantial length. To create the impression of such a long garland, short garland light sets may be combined together, thereby to extend along the longitudinal axis further than any single garland light set.

Garland light sets are well known in the art and frequently used for festive occasions (such as Christmas). The garland light set is usually in the form of a flexible structure which is typically extended in one direction (typically horizontally) and often suspended in such a manner as to define at least one swag or arcuate portion intermediate a pair of adjacent suspension or connection points. Where there are a plurality of vertically aligned, vertically spaced swags, each swag may be formed by a separate light string extending between a pair of adjacent connection points, with the several light strings being twisted together, if at all, only at the several common connection points.

However, a more aesthetic and historically accurate garland impression is formed by having a plurality of longitudinally-extending light strings physically twisted together to define a single garland extending along a longitudinal axis (whether linear, arcuate or circular), the several light strings being physically twisted together along substantially the entire length of the several light strings to create the overall visual impression of an extremely thick rope.

Each of the light strings in such a garland include a plurality of lamp sockets electrically wired in series and longitudinally spaced along a longitudinal axis of the respective light string. Wire means physically and electrically connect in series each lamp socket of the respective light string along the respective longitudinal light string axis. However, due to the helter skelter angular orientation of the lamp sockets and the lamps associated therewith—which orientations may range for any given lamp socket anywhere from parallel to the light string longitudinal axis to forming a 90 degree angle therewith—the overall visual impression created by the garland light set is typically more of a relatively thin rope with lamp sockets and lamps more-or-less randomly secured thereto. In some instances the wire means at least partially conceal the various lamps.

Accordingly, it is an object of the present invention to provide a garland light set affording an aesthetic and historically accurate impression of regularly spaced apart floral blooms interconnected by twisted together stems.

Another object is to provide such a garland light set wherein the various lamp sockets and lamps therein are generally uniformly and regularly coaxially yet slightly divergently disposed with respect to the longitudinal axis of the garland light set.

A further object is to provide such a garland light set which is formed of a plurality of light strings, with the lamp sockets of the various light strings being grouped together in respective generally transverse planes (spaced apart along the longitudinal axis of the garland light set) with the lamp sockets of the other light strings.

SUMMARY OF THE INVENTION

It has now been found that the above and related objects of the present invention are obtained in a garland light set comprising a plurality of longitudinally-extending light strings physically twisted together to define a garland extending along a longitudinal axis. Each of the light strings includes a plurality of lamp sockets electrically wired in series and longitudinally spaced along a longitudinal axis of the respective light string, wire means physically and electrically connecting in series each lamp socket of a respective light string along the respective longitudinal light string axis, and means for orienting each lamp socket generally coaxially with the respective longitudinal light string axis.

In a preferred embodiment, the lamp sockets of one (preferably each) of the light strings are disposed in respective generally transverse planes encompassing corresponding ones of the lamp sockets of another (preferably each other) of the light strings. Preferably the lamp sockets in one generally transverse plane are adjacent but longitudinally spaced from the lamp sockets in an adjacent generally transverse plane, and the lamps disposed in the lamp sockets in the one generally transverse plane overlap the lamp sockets in the adjacent generally transverse plane. The wire means of the light strings are twisted together for substantially their entire length intermediate lamp sockets spaced along the respective longitudinal light string axes and for substantially their entire length intermediate adjacent ones of the generally transverse planes.

Preferably, each orienting means is permanently secured to a respective one of the light sockets and removably secured to a respective one of the wire means. Each said orienting means is a resilient clip formed on one of the lamp sockets and removably engaging one of the wire means. Each orienting means orients the respective lamp socket at least slightly divergently away from the respective longitudinal light string axis. In a preferred embodiment, for a plurality of the orienting means, each orienting means engages one of the wire means of the respective light string contiguous to the respective one light socket. Preferably at least one of the orienting means either engages a plurality of the wire means or at least one wire means of a different one of the light strings.

At any given point along its length, a four light string thick light set may comprise four of the light strings electrically wired in parallel or two pairs of the light strings, with the light strings of each pair being electrically wired in parallel.

In combination, a pair of the garland light sets comprise a pair of the light strings, at least a length of the wire means of one set being twisted together with at least a length of the wire means of the other set.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
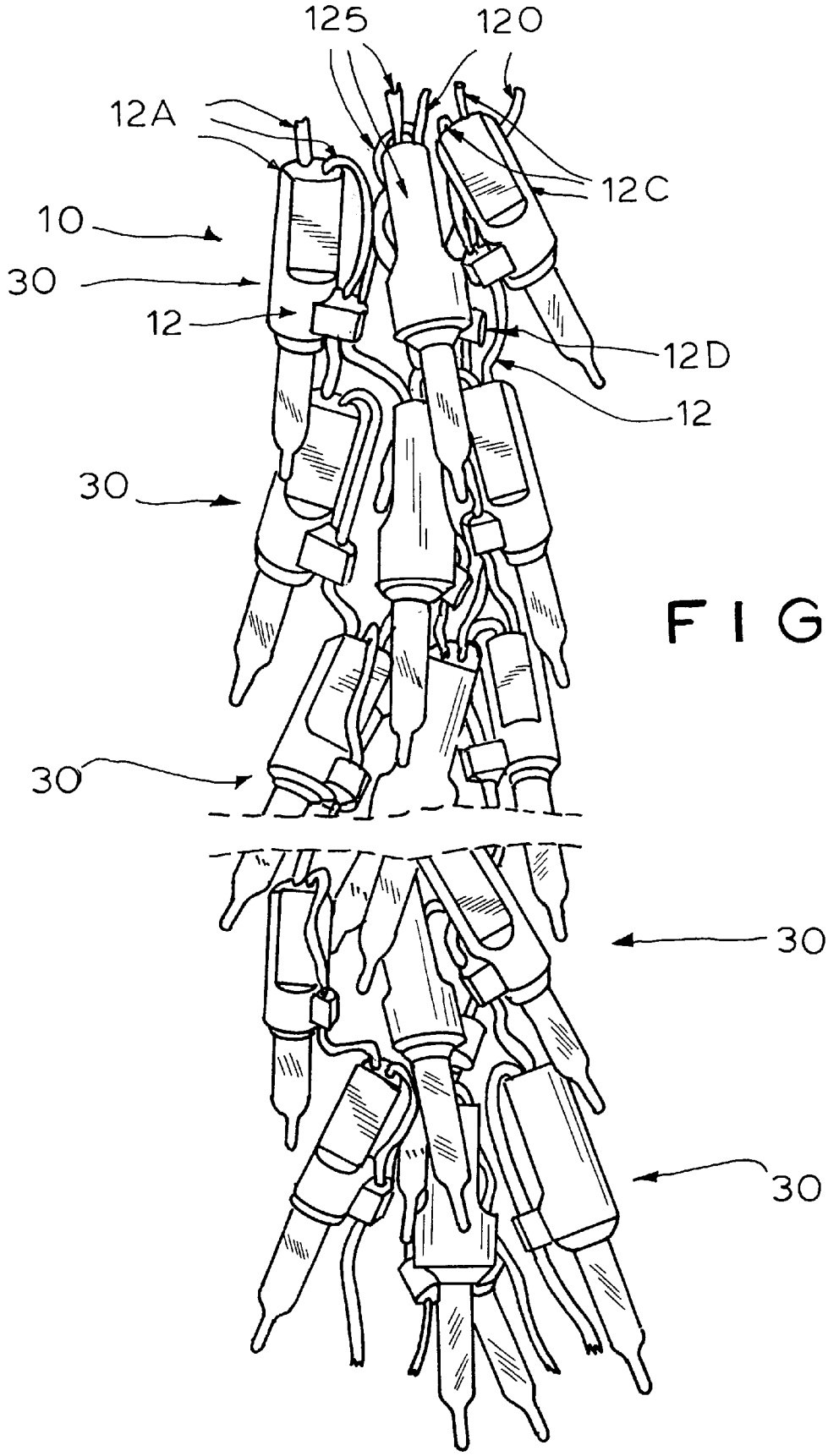
FIG. 1 is a fragmentary view of a portion of the garland light set according to the present invention.

Referring now to the drawing, and in particular to FIG. 1 thereof, therein illustrated is a garland light set according to the present invention, generally designated by the reference numeral 10. The portion of the light set 10 illustrated in FIG. 1 is shown as broken away from the remainder of the light set at each end and as broken away in the center of the portion to indicate indeterminate length.

The light set 10 comprises a plurality of longitudinally extending light strings 12A, 12B, 12C, and 12D. While four light strings 12A–12D are illustrated in FIG. 1, clearly a light set 10 may be made of fewer light strings (for example, three light strings) or more light strings (for example, five light strings). The light strings are physically twisted together to define a garland extending along a longitudinal axis. As portions of the light strings 12 are flexible, the longitudinal axis along which the garland extends may be linear, arcuate or even circular or polygonal.

Figure 2:
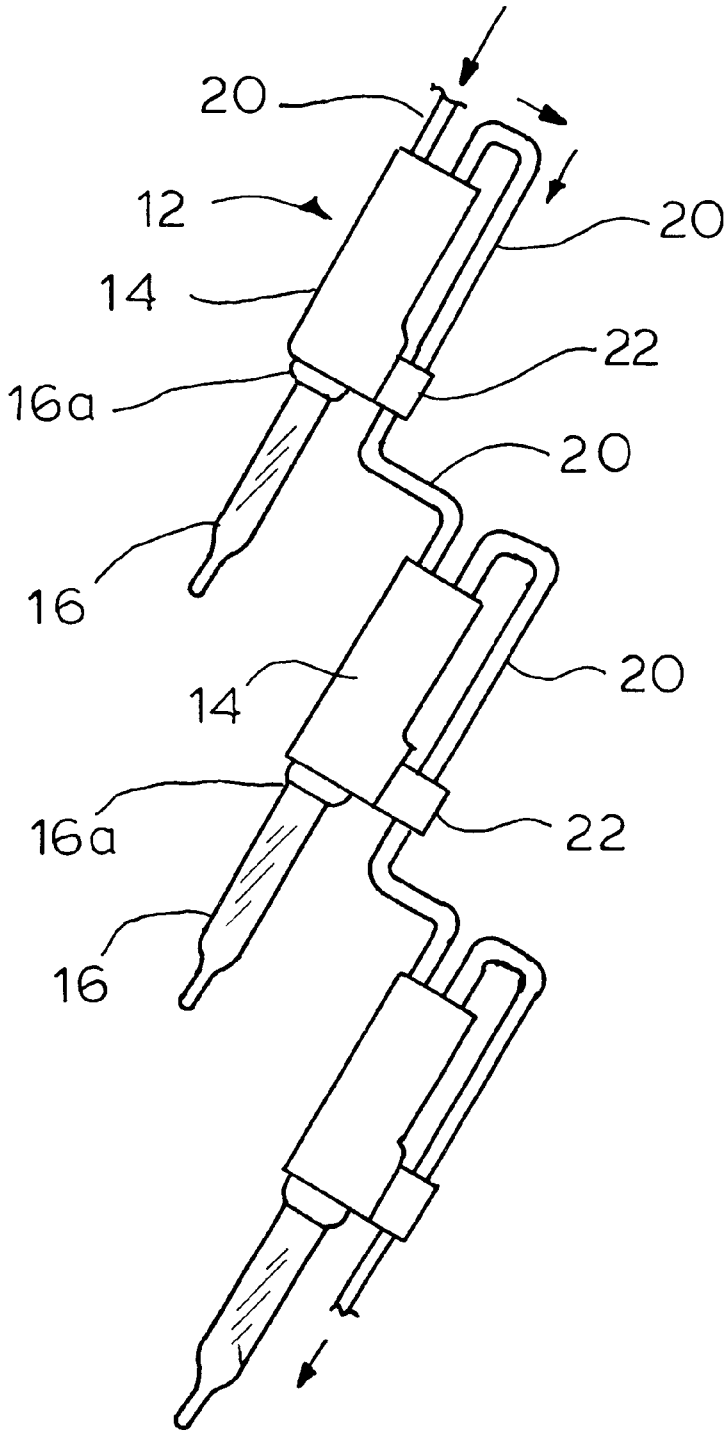
FIG. 2 is a fragmentary schematic side elevational view of a single light string of the garland light set.

Referring now to FIG. 2 in particular, therein illustrated for illustrative purposes is a fragmentary single light string 12. The light string 12 includes a plurality of lamp sockets 14 (and, as illustrated, lamps 16), wire means 20 and means 22 for orienting each lamp socket 14.

More particularly, the plurality of lamp sockets 14 of a given light string 12 are electrically wired in series (by means of the wire means 20) and longitudinally spaced along a longitudinal axis of the respective light string 12, e.g., 12A, 12B, 12C, 12D. The light strings have the size and configuration commonly used for Christmas ornamentation, for example, for decorations of a Christmas tree, door, roof, chimney, and the like. Typically, the lamp 16 is removable from the lamp socket 14 to enable replacement of a lamp 16 that has burned out or broken, but features such as the releasable locking means available under the trade name LAMP-LOK from Minami International Corporation may be used to prevent accidental separation of the lamp socket 14 and lamp 16. (As will be apparent to those skilled in the art, reference to lamp 16 herein includes as a part thereof the lamp base 16*a*, which is insertable into and removable from the socket 14 with the lamp 16.)

The wire means 20 physically and electrically connects in series each lamp socket 14 of the respective light string 12 along its respective longitudinal light string axis. When the wire means 20 connects the lamps 16 in series, failure or removal of a single lamp 16 from a light string 12 will result in extinguishment of each lamp 16 of the light string 12. Accordingly, the individual lamps 16 may be secured to the wire means 20 by a socket 14 which provides a parallel connection of the lamp 16 to the wire means 20 so that extinguishment or removal of one lamp 16 does not affect the other lamps 16 in that light string 12. The wire means 20 is conveniently thought of as a single wire, although in fact it may be simply a collection of separate wire portions which are connected in series by the lamp sockets 14. The wire means 20 constitutes the flexible portion of the light string 12, and flexure or bending of the garland light set 10 occurs at the wire means 20 rather than at the sockets 14 (or lamps 16).

Each lamp socket 14 includes a base 14*a*, at the end opposite the chamber which receives the lamp 16 and lamp base 16*a*, the socket base 14*a* defining at least a pair of small apertures 14*b*. One aperture 14*b* is occupied by a portion of the wire means 20 which conducts current into the socket 14 from an upstream socket, while the other aperture 14*b* is occupied by an adjacent wire portion which conducts current out of the socket 14 and into a downstream socket. It will be appreciated by those familiar with the light set art that, while typically the portion of wire means 20 conducting current out of one socket 14 carries the current into the immediately adjacent downstream socket 14, in fact it may directly carry the current instead to a downstream socket which is not immediately adjacent thereto.

The orienting means 22 orients each lamp socket 14 generally coaxially with the respective longitudinal axis of the respective light string 12. The orienting means 22 is preferably of one-piece, unitary and integral construction with the lamp socket 14, the lamp socket 14 and orienting means 22 typically being formed of plastic in a single molding operation, thereby to reduce both manufacturing and assembly costs.

Figure 3:
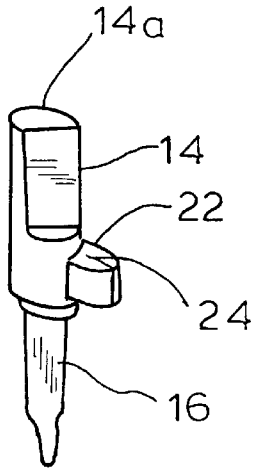
FIG. 3 is an isometric view of a single socket of the single light string of FIG. 2.

Referring now in particular to FIG. 3, therein illustrated is a single lamp socket 14 (and a lamp 16 and lamp base 16*a*) and a preferred orienting means 22. As illustrated, the orienting means 22 is a resilient split lug defining a slot 24 configured and dimensioned to be able to receive and releasably maintain therein at least one wire means 20 placed into the slot through the open end thereof with sufficient force to overcome the natural resistance of the lug 22 to opening.

Referring back to FIG. 1, it will be appreciated that the lamp sockets 14 are spaced along the respective longitudinal light string axes in such a way that the lamp sockets 14 of one of the light strings 12A–12D are disposed in respective generally transverse planes encompassing corresponding ones of the lamp sockets 14 of another of the light strings 12. More particularly, in the preferred embodiment illustrated the lamp sockets 14 of each of the light strings 12 are disposed in respective generally transverse planes encompassing corresponding ones of the lamp sockets 14 of each other of the light strings 12. In other words, here, where there are four light strings 12, four sockets 14 are grouped together in a single plane generally transverse to the longitudinal axis of the light set 10 to form a "bunch" 30 corresponding to the flower or head of a floral garland, the various bunches 30 being connected by means of the several intertwined wire means 20 corresponding to the stems of a floral garland.

The wire means 20 of the several light strings 12A–12D are twisted together for substantially their entire length intermediate the lamp sockets 14 spaced along the respective longitudinal light string axes. Accordingly, the wire means 20 of the several light strings 12 are twisted together for substantially their entire length intermediate adjacent bunches 30—that is, intermediate adjacent ones of the generally transverse planes defined by the lamp sockets 14.

It should be kept in mind that preferably, while each of the orienting means 22 is permanently secured to one of the light sockets 14, it is only removably or releasably secured to a respective one of the wire means 20. Each orienting means 22 is preferably a resilient split lug formed on one of the lamp sockets 14 (as an integral, unitary and one-piece construction therewith) for removably engaging one of the wire means 20. Each orienting means 22 orients the respective lamp socket 14 of which it is a part in an orientation such that the lamp socket 14 is generally parallel to, but at least slightly divergent away from, the respective longitudinal light string axis. On the other hand, if the orienting means 22 orient the lamp socket 14 too close to a transverse orientation relative to the respective longitudinal light string axis, then the sockets 14 and especially their lamps 16 are too far spaced apart from one another to provide a flower head or bud ("bunch") appearance. On the other hand, if the orienting means 22 orient the lamp sockets 14 too close to a parallel orientation to the respective longitudinal light string axis, even the four sockets 14 and associated lamps 16 do not bunch out sufficiently, transverse to the axis, to simulate a flower head or bud ("bunch").

A socket length of about 1.8 cm, a bunch-to-bunch or transverse plane separation (from the beginning of one bunch to the beginning of the adjacent bunch) of about 3 cm along the longitudinal axis of the light set, and a slight socket axis divergence of about 10° from the longitudinal axis of the light set provide a satisfying aesthetic experience. The orienting means 22 provides for a rough regularity of the angle of divergence of the light sockets 14 from their respective longitudinal light string axes which is not obtainable simply by reliance upon the bendability and resilience of the wire means 20 alone.

Generally, as illustrated, at least one—and typically most—of the orienting means 20 engages (i.e., receives and maintained) one of the wire means 20 of the respective light string 12, most commonly the wire means 20 contiguous to (and carrying current out of) the respective one light socket 14 bearing the orienting means 22.

In order to further assist the natural twisting of the wire means 20 in maintaining a relatively thin and well-defined longitudinal axis for the combined light strings, preferably at least one of the orienting means 22 engages (i.e., receives and maintains) a plurality of the wire means 20. Thus at least one of the orienting means 22 of a lamp socket 14 of one light string 12 engages one of the wire means 20 of a different one of the light strings 12 rather than only the wire means 20 of the same light string 12.

Where the manufacture of the light set 10 involves the engagement of an orienting means 22 and wire means 20 after the various light strings 12 have been twisted together, it is common that, if only due to human imprecision and error, at least one of the orienting means 22 either engages a plurality of wire means 20 or at least engages one of the wire means 20 of a different one of the light strings 12. Preferably, the majority of the orienting means 22 engage one of the wire means 20 of the respective light string 12 contiguous to the respective one light socket 14, as illustrated for most of the orienting means/wire means connections illustrated in FIG. 1.

From both a practical viewpoint (to provide flexibility in the light set) and an aesthetic point of view (to maintain the "bunch" 30 of light sockets in a given transverse plane separate from the "bunch" 30 of lamp sockets in an adjacent transverse plane), the lamp sockets 14 in one generally transverse plane are adjacent, but longitudinally spaced from, the lamp sockets in an adjacent generally transverse plane. Preferably the lamps 16 disposed in the lamp sockets 14 in one generally transverse plane overlap the lamp sockets 14 in the adjacent generally transverse plane downstream.

Figure 4:
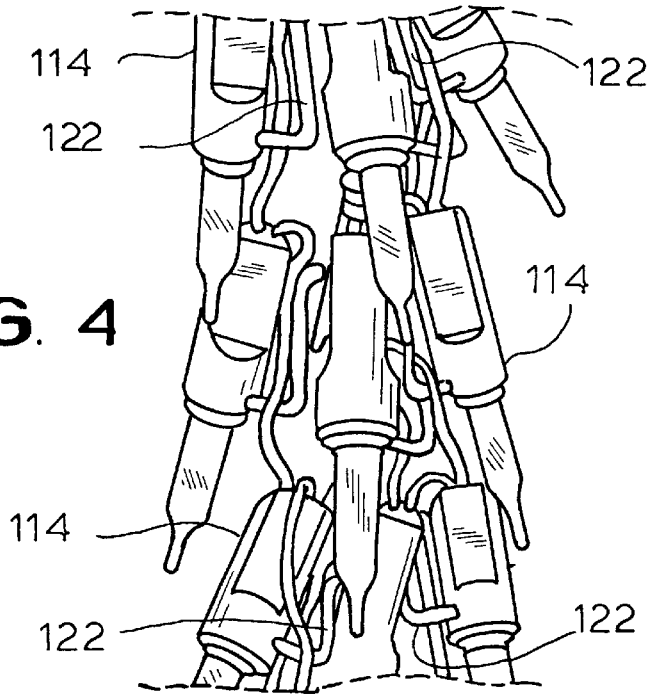
FIG. 4 is a fragmentary view of a portion of a variant of the garland light set of FIG. 1.
Figure 5:
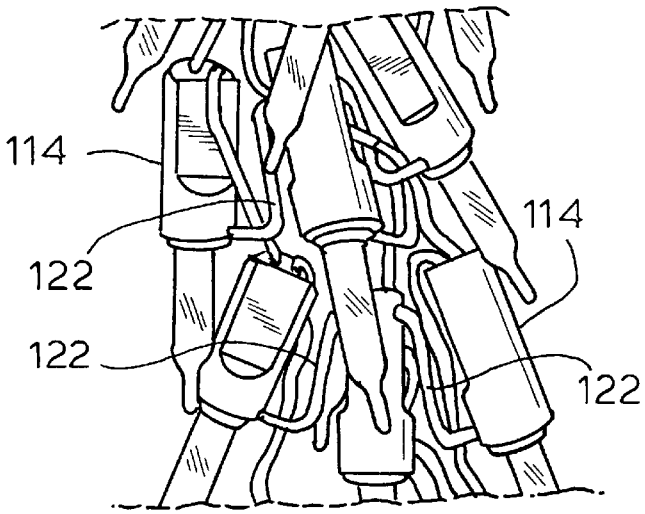
FIG. 5 is an isometric view of a single socket of a single light string of the garland light set of FIG. 4.
Figure 5:
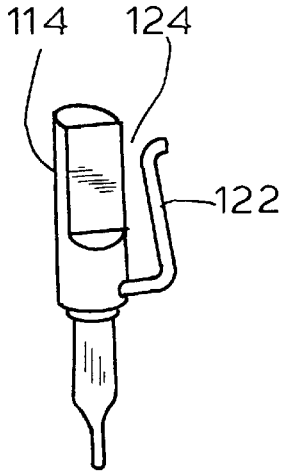

Referring now to FIG. 4, therein illustrated is a variant 100 of the lamp set 10 illustrated in FIG. 1. Corresponding reference numerals are used in FIGS. 1 and 4, except that the first embodiment reference numerals are two digits and the variant reference numerals are corresponding three digit numbers in the 100 series. Essentially the only distinction between the base embodiment 10 and the variant 100 is that the base embodiment 10 uses the socket 14 illustrated in FIG. 3 and the variant 100 uses the socket 114 illustrated in FIG. 5. The two sockets 14, 114 are essentially identical except for the orienting means. The orienting means 22 of FIG. 3 is a resilient split lug 22 defining a slot 24, while the orienting means 122 of FIG. 5 is a clasp separable adjacent its free end from the socket 114 by a space 124 sufficient to allow passage of a wire means 20 therethrough. Typically the clasp 122 is resilient and the space 124 is normally somewhat less than required to permit easy passage therethrough of a wire means 20, the resilient clasp 122 being flexible outwardly from the socket 14 (for example, by forcible movement of the wire means 20) sufficiently to allow passage of the wire means 20 through the enlarged space resulting from flexing of the clasp 122.

Figure 6:
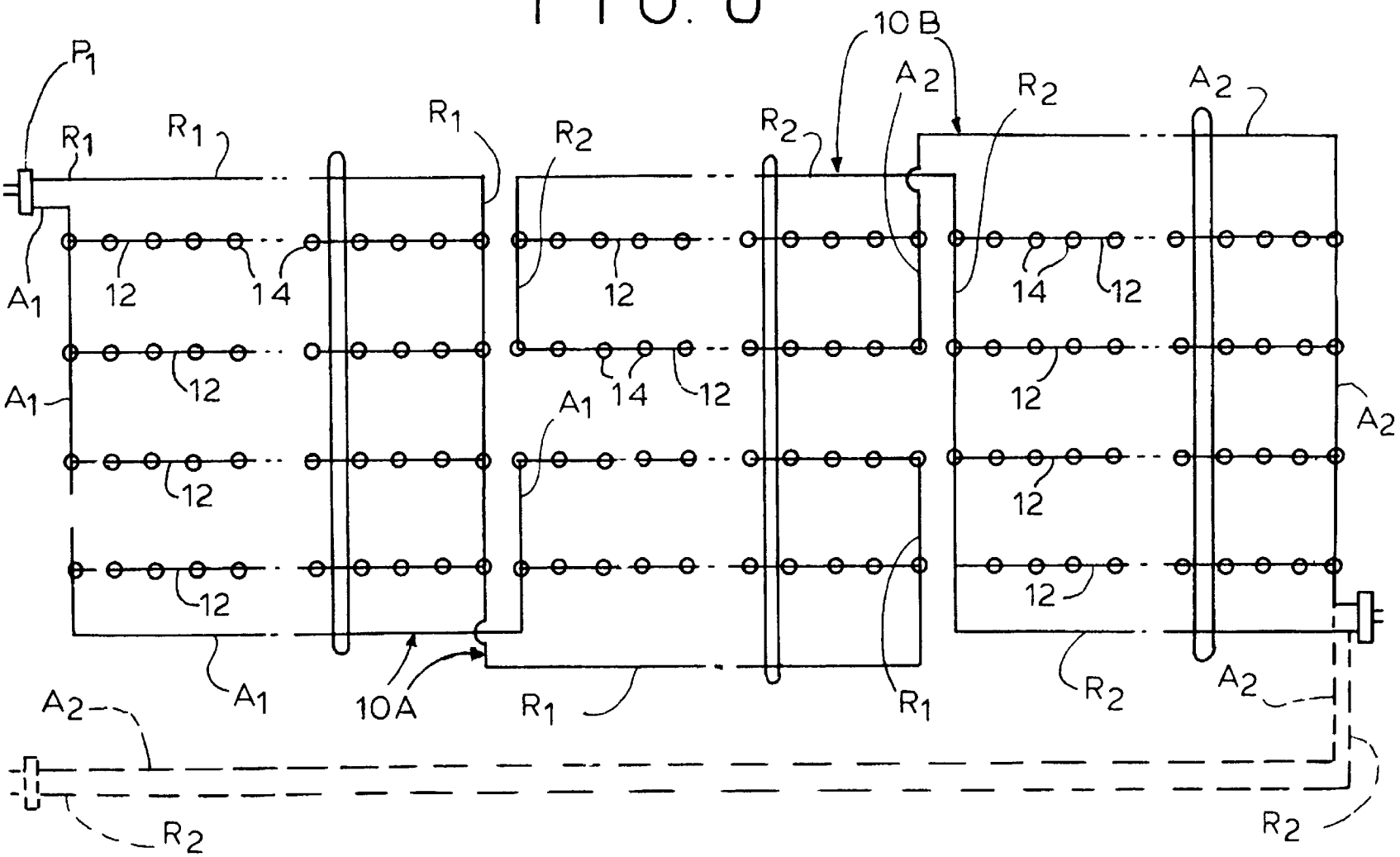
FIG. 6 is a fragmentary circuit diagram of a first embodiment of a pair of garland light sets according to the present invention, with an alternate placement of one end connector being illustrated in broken line.
Figure 7:
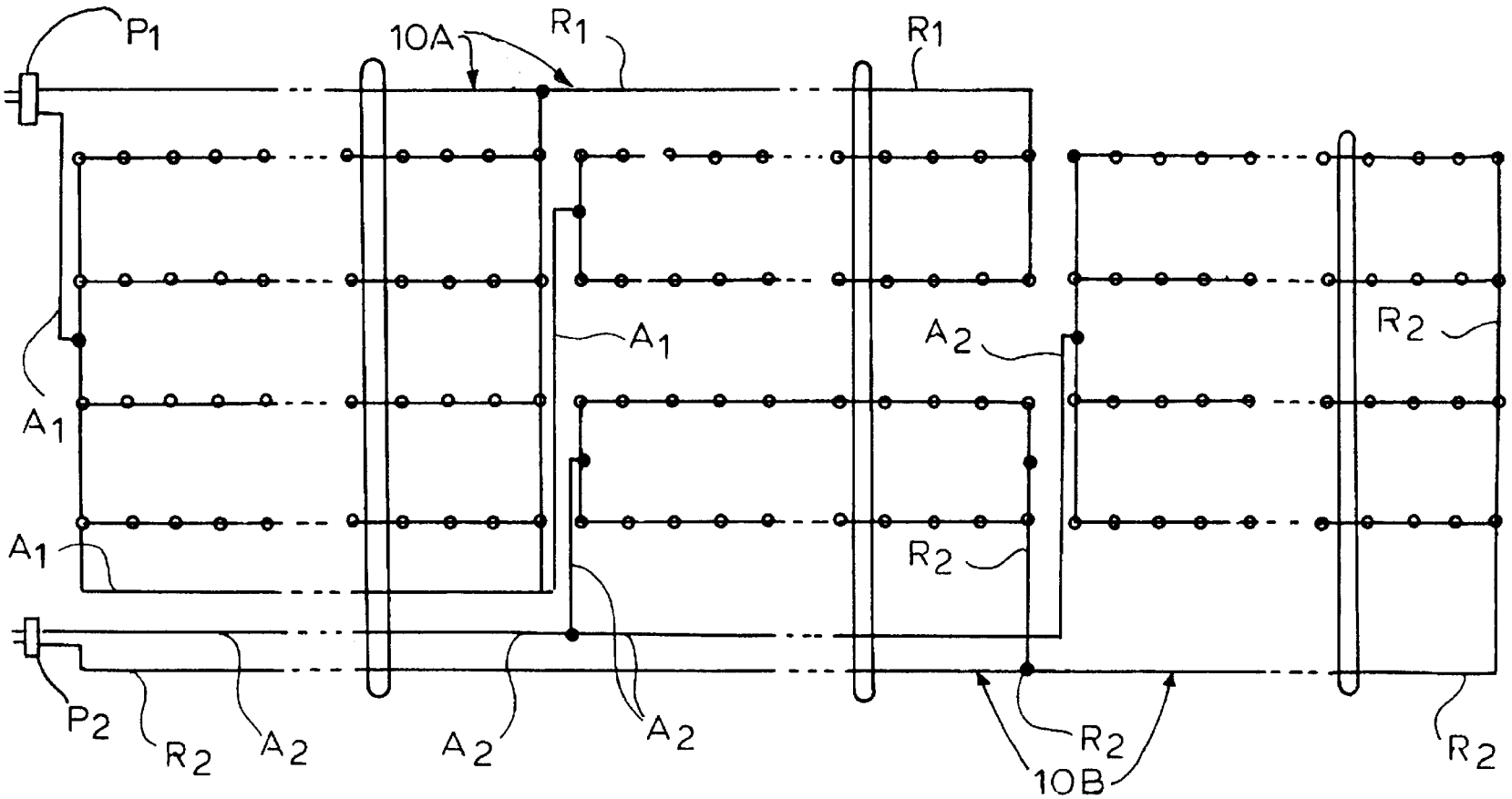
FIG. 7 is a fragmentary circuit diagram of a second embodiment thereof.
Figure 8:
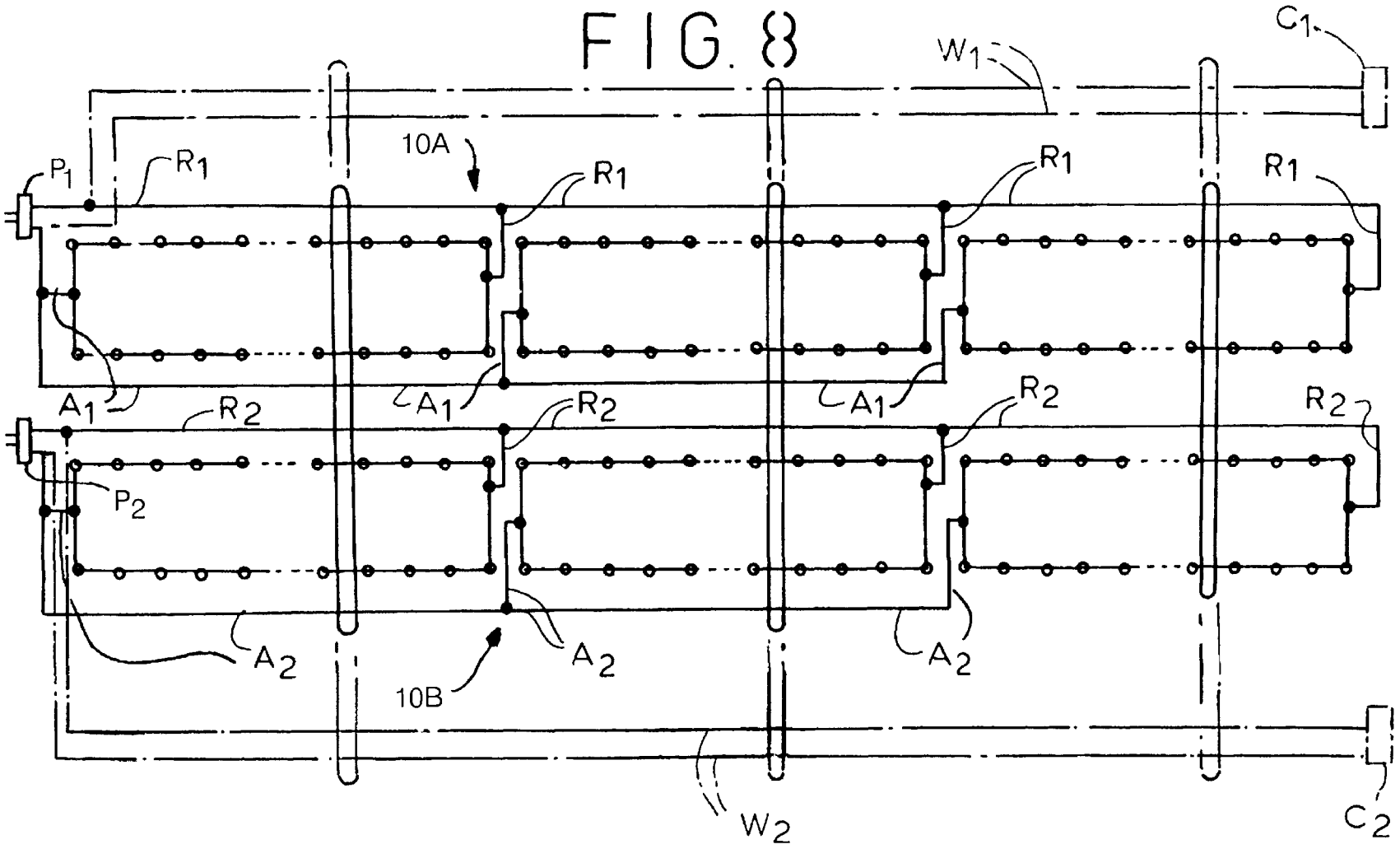
FIG. 8 is a fragmentary circuit diagram of a third embodiment thereof.

Referring now to FIGS. 6–8, therein illustrated are circuit diagrams of preferred configurations for combinations of two garland light sets 10A, 10B according to the present invention. On the one hand, the number of lamps 16 in series which can be lit in a given light set 10 will depend upon the voltage differential available at the plug and the voltage drop across each lamps disposed in the series between an active wire and a return wire connected to that plug. On the other hand, while the available voltage differential at the plug does not affect how many light strings 12 containing lamps 16 in series may be secured between the active wire and the return wire (because each light string receives the same voltage differential), the number of light strings 12 which can be disposed in parallel is limited by the current-carrying capacity of the active and return wires. Preferably, no more than six to nine 50 bulb light strings 12 are connected in a single light set 10 using a single plug. Thus, since the garland light set of the present invention (when sized for a typical door frame) requires twelve light strings, two sets 10A and 10B (with two plugs $P_1$, $P_2$) are utilized as shown in each of FIGS. 6–8.

Referring now to FIG. 6, therein illustrated is a first light set 10A including an active wire $A_1$, a return wire $R_1$ and six light strings 12 disposed in parallel therebetween (each light string 12 including a plurality of lamp sockets 14 disposed in series) and a second light set 10B including an active wire $A_2$, and a return wire $R_2$, and six light strings 12 disposed in parallel therebetween. In order to maintain the desired four light strings 12 constituting a bunch of a garland light set 10, four of the light strings 12 of each light set 10A, 10B (as illustrated in the left and right segments of FIG. 6) are intertwined together—as illustrated by the vertical thin ellipse—and thus all of the vertically aligned lamps of the four light strings 12 are disposed in a common transverse plane. The remaining two light strings 12 of each light set 10A and 10B are extended (and optionally flipped around) so as to form a two-light-string extension. The two two-light-string extensions (one from the first light set 10A and one from the second light set 10B) remain electrically independent of one another, but are physically overlaid and intertwined—as illustrated by the vertical thin ellipse in the middle segment of FIG. 6—so that all of the vertically aligned lamps of the four physically overlaid light strings 12 are disposed in a common tranverse plane.

While FIG. 6 shows the two plugs (that is, the plug $P_1$ of the first light set 10A and the plug $P_2$ of the second light set 10B) disposed at opposite ends of the combined two light sets in solid line, one of the plugs $P_2$ may be relocated (as illustrated in phantom line) so as to be on the same end as the other plug $P_1$. Indeed, when the two plugs are on the same side, one plug may also act as a receptacle for the other plug such that both plugs receive the same full voltage differential from a single wall socket (not shown).

As illustrated in FIG. 6, each of the three segments of the combined light sets contains the same number of wires (here illustrated as six wires or, including the phantom line wires, eight wires).

The configuration of the combined light sets 10A, 10B illustrated in FIG. 7 is functionally equivalent to that shown in FIG. 6. The plug $P_2$ of the second set 10B returns to the same side as the plug $P_1$ of the first set 10A, as illustrated in phantom line in FIG. 6. Modifications are made only in the orientation of the segments, with the result that some of the segments have fewer wires than others.

The configuration of the combined light set 10A, 10B configuration illustrated in FIG. 8 has each light set 10A, 10B extending the full length of the combined light sets, but with at most two light strings physically parallel in each segment. Thus, there are four light strings (two light strings from each set 10A, 10B) intertwined in each segment.

Thus, at any given point along the longitudinal length of a four light string thick light set, there may be four physically intertwined light strings electrically wired in parallel (as illustrated in the end segments of the configurations of FIGS. 6 and 7) or two physically intertwined pairs of light strings, with the light strings of each pair being electrically wired in parallel (as illustrated in the middle segments of FIGS. 6 and 7 and all three segments of FIG. 8).

In the United States, where the voltage differential at the home wall socket (and hence the plug) is typically 110–120 volts and each lamp is designed for use with a maximum 2.5 volt drop, each light string consists of about 50 lamps electrically connected in series. The gauge (thickness) of the conductive wire connected to the plug limits the number of light strings which may be connected in parallel as that conductive wire must carry the current for all the light strings.

Where it is desirable for the pair of combined garland light sets 10A, 10B to extend further along the longitudinal axis than is possible for the three segments illustrated in FIGS. 6 through 8 (i.e., the right, left and intermediate segments), the plugs $P_1$ and $P_2$ thereof may be connected by auxiliary wire means to respective end connectors configured and dimensioned to receive the respective plugs of another combined pair of garland light sets and provide such plugs with the full voltage differential available to the original plugs $P_1$ and $P_2$. For example, referring now to FIG. 8 in particular, therein illustrated are female end connectors $C_1$ and $C_2$, each connected to a respective plug $P_1$ or $P_2$ of the original pair of combined light sets 10A, 10B by respective auxiliary wire means $W_1$ or $W_2$, (the end connectors $C_1$, $C_2$ and auxiliary wire means $W_1$, $W_2$ being illustrated in phantom line). In this instance the auxiliary wire means $W_1$, $W_2$ would be physically intertwined with the wires $A_1$, $R_1$ of light set 10A and $A_2$, $R_2$, of light set 10B, as indicated by the phantom line extensions of the thin vertical ellipses. Needless to say, if desired, there may be only a single end connector (e.g., $C_1$) connected by auxiliary wire means (e.g., $W_1$) to one of the plugs (e.g., $P_1$) of the combined garland light sets.

Similarly, if it is desirable to have an extendable single garland light set (e.g., 10A) its single plug (e.g., $P_1$) may be connected to an end connector (e.g., $C_1$) by auxiliary wire means (e.g., $W_1$) so that another garland light set may be electrically connected in parallel with the original one (e.g., 10A), although not physically intertwined (twisted together) therewith.

To summarize, the present invention provides a garland light set affording an aesthetic and historically accurate impression of regularly spaced apart floral blooms (heads or bouquets) interconnected by twisted together (braided or plaited) stems. The various lamp sockets and lamps are generally uniformly and regularly coaxially (yet slightly divergently) disposed with respect to the longitudinal axis of the garland light set. The garland light set is formed of a plurality of light strings, with the lamp sockets for the various light strings being grouped together in respective generally transverse planes (spaced along the longitudinal axis of the garland light set) with the lamp sockets of the other light string.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. A garland light set comprising:

(A) a plurality of longitudinally-extending light strings physically twisted together to define a garland extending along a longitudinal axis, each of said light strings including:

(i) a plurality of lamp sockets electrically wired in series and longitudinally spaced along a longitudinal axis of said respective light string;

(ii) wire means physically and electrically connecting in series each said lamp socket of said respective light string along said respective longitudinal light string axis; and (iii) means for orienting each said lamp socket generally coaxially with said respective longitudinal light string axis and at least slightly divergently away from said respective longitudinal light string axis.

2. The light set of claim 1 wherein said lamp sockets of one of said light strings are disposed in respective generally transverse planes encompassing corresponding ones of said lamp sockets of another of said light strings.

3. The light set of claim 2 wherein said lamp sockets of each said light string are disposed in respective generally transverse planes encompassing corresponding ones of said lamp sockets of each other of said light strings.

4. The light set of claim 1 wherein said wire means of said light strings are twisted together for substantially their entire length intermediate lamp sockets spaced along said respective longitudinal light string axes.

5. The light set of claim 2 wherein said wire means of said light strings are twisted together for substantially their entire length intermediate adjacent ones of said generally transverse planes.

6. The light set of claim 3 wherein said wire means of said light strings are twisted together for substantially their entire length intermediate adjacent ones of said generally transverse planes.

7. The light set of claim 1 wherein each said orienting means is permanently secured to a respective one of said light sockets and removably secured to a respective one of said wire means.

8. The light sets of claim 7 wherein each said orienting means is a resilient clip formed on one of said lamp sockets and removably engaging one of said wire means.

9. The light set of claim 1 wherein a plurality of said orienting means engages one of said wire means of said respective light string.

10. The light set of claim 1 wherein a plurality of said orienting means engages one of said wire means contiguous to said respective one light socket.

11. The light set of claim 1 wherein at least one of said orienting means engages a plurality of said wire means.

12. The light set of claim 1 wherein at least one of said orienting means engages one of said wire means of a different one of said light strings.

13. The light set of claim 1 comprising four of said light strings electrically wired in parallel.

14. The light set of claim 1 comprising two pairs of said light strings, with the light strings of each pair being electrically wired in parallel.

15. The light set of claim 2 wherein said lamp sockets in one generally transverse plane are adjacent but longitudinally spaced from said lamp sockets in an adjacent generally transverse plane.

16. The light set of claim 15 wherein the lamps disposed in said lamp sockets in the one generally transverse plane overlap said lamp sockets in the adjacent generally transverse plane.

17. The light set of claim 1 additionally including a return wire means electrically connected to at least one of said lamp sockets.

18. The light set of claim 1 wherein at least one of said orienting means engages a plurality of said wire means, and at least one of said orienting means engages one of said wire means of a different one of said light strings.

19. In combination, a pair of the garland light sets of claim 1, comprising a pair of said light strings, at least a length of said wire means of one said set being twisted together with at least a length of said wire means of the other said set.

20. A garland light set comprising:

(A) a plurality of longitudinally-extending light strings physically twisted together to define a garland extending along a longitudinal axis, each of said light strings including:

(i) a plurality of lamp sockets electrically wired in series and longitudinally spaced along a longitudinal axis of said respective light string, said lamp sockets of each of said light strings being disposed in respective generally transverse planes encompassing corresponding ones of said lamp sockets of each other of said light strings;

(ii) wire means physically and electrically connecting in series each said lamp socket of said respective light string along said respective longitudinal light string axis, said wire means being twisted together with said wire means of at least one other said light string for substantially their entire length; and (iii) means for orienting each said lamp socket generally coaxially with said respective longitudinal light string axis and at least slightly divergently away from said respective longitudinal light string axis, each said orienting means being a resilient clip formed on one of said lamp sockets and removably engaging one of said wire means.

21. The light set of claim 20 wherein at least one of said orienting means engages a plurality of said wire means.

22. The light set of claim 20 wherein at least one of said orienting means engages one of said wire means of a different one of said light strings.

23. The light set of claim 20 wherein at least one of said orienting means engages one of said wire means of said respective light string.

24. The light set of claim 20 wherein at least one of said orienting means engages a wire means contiguous to said respective one light socket.

25. The light set of claim 20 comprising four of said light strings electrically wired in parallel.

26. The light set of claim 20 comprising two pairs of said light strings, with the light strings of each pair being electrically wired in parallel.

27. The light set of claim 20 wherein said lamp sockets in one generally transverse plane are adjacent but longitudinally spaced from said lamp sockets in an adjacent generally transverse plane, and the lamps disposed in said lamp sockets in the one generally transverse plane overlap said lamp sockets in the adjacent generally transverse plane.

28. The light set of claim 20 additionally including a return wire means electrically connected to at least one of said lamp sockets.

29. The light set of claim 20 wherein a plurality of said orienting means engage one of said wire means of said respective light string contiguous to said respective one light socket and at least one of said orienting means engages a plurality of said wire means and at least one of said orienting means engages one of said wire means of a different one of said light strings.

30. In combination, a pair of the garland light sets of claim 20, comprising a pair of said light strings, at least a length of said wire means of one said set being twisted together with at least a length of said wire means of the other said set.

31. The combination of claim 30 wherein each of said pair of garland light sets includes at one end a plug, at an opposite end an end connector, and physically therebetween a pair of auxiliary wire means electrically connecting in parallel said plug and said end connector, said pair of auxiliary wire means being twisted together with at least one of said wire means of said pair of garland light sets.

32. The light set of claim 20 wherein said garland light set includes at one end a plug, at an opposite end an end connector, and physically therebetween a pair of auxiliary wire means electrically connecting in parallel said plug and said end connector, said pair of auxiliary wire means being twisted together with at least one of said wire means of said garland light set.

33. In combination, a pair of garland light sets, (A) each garland light set comprising a plurality of longitudinally-extending light strings physically twisted together to define a garland extending along a longitudinal axis, each of said light strings including:

(i) a plurality of lamp sockets electrically wired in series and longitudinally spaced along a longitudinal axis of said respective light string;

(ii) wire means physically and electrically connecting in series each said lamp socket of said respective light string along said respective longitudinal light string axis; and (iii) means for orienting each said lamp socket generally coaxially with said respective longitudinal light string axis;

(B) in said combination at least a length of said wire means of one said set being twisted together with at least a length of said wire means of the other said set.

34. In combination, a pair of garland light sets, (A) each garland light set comprising a plurality of longitudinally-extending light strings physically twisted together to define a garland extending along a longitudinal axis, each of said light strings including:

(i) a plurality of lamp sockets electrically wired in series and longitudinally spaced along a longitudinal axis of said respective light string, said lamp sockets of each of said light strings being disposed in respective generally transverse planes encompassing corresponding ones of said lamp sockets of each other of said light strings;

(ii) wire means physically and electrically connecting in series each said lamp socket of said respective light string along said respective longitudinal light string axis, said wire means being twisted together with said wire means of at least one other said light string for substantially their entire length; and (iii) means for orienting each said lamp socket generally coaxially with said respective longitudinal light string axis, each said orienting means being a resilient clip formed on one of said lamp sockets and removably engaging one of said wire means;

(B) in said combination at least a length of said wire means of one said set being twisted together with at least a length of said wire means of the other said set.

35. The combination of claim 34 wherein each of said pair of garland light sets includes at one end a plug, at an opposite end an end connector, and physically therebetween a pair of auxiliary wire means electrically connecting in parallel said plug and said end connector, said pair of auxiliary wire means being twisted together with at least one of said wire means of said pair of garland light sets.

* * * * *